US009062944B1

(12) United States Patent
Dupuis

(10) Patent No.: US 9,062,944 B1
(45) Date of Patent: Jun. 23, 2015

(54) BROADHEAD ARROWHEAD

(71) Applicant: Michel P. Dupuis, Marblehead, MA (US)

(72) Inventor: Michel P. Dupuis, Marblehead, MA (US)

( * ) Notice: Subject to any disclaimer, the term of this patent is extended or adjusted under 35 U.S.C. 154(b) by 0 days.

(21) Appl. No.: 14/201,314

(22) Filed: Mar. 7, 2014

(51) Int. Cl.
*F42B 6/08* (2006.01)
*F42B 6/04* (2006.01)

(52) U.S. Cl.
CPC .... *F42B 6/08* (2013.01); *F42B 6/04* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 2,940,758 | A * | 6/1960 | Richter | 473/584 |
| 4,381,866 | A * | 5/1983 | Simo | 473/584 |
| 5,257,809 | A | 11/1993 | Carrizosa | |
| 6,171,206 | B1 | 1/2001 | Liechty, II | |
| 6,319,161 | B1 * | 11/2001 | Martinez et al. | 473/583 |
| 6,887,172 | B2 | 5/2005 | Arasmith | |
| 6,918,848 | B2 * | 7/2005 | Kuhn | 473/583 |
| 7,771,297 | B2 | 8/2010 | Kuhn | |
| 8,313,398 | B2 | 11/2012 | Baker | |
| 2013/0203530 | A1 | 8/2013 | Patton | |

OTHER PUBLICATIONS

Liue, D.K., et al. "The Mechanics of Arrow Flight upon Release"; Posted to docstoc.com on Jul. 30, 2012; 12 pgs.
William Brantley; "How to Tune Your Bow: 15 Steps to Perfect Arrow Flight;" www.fieldandstream.com/articles/hunting/2012/10/15-steps-pertect-arrow-flight; Oct. 8, 2012, 4 pages.
"Archery, Arrows & Arrow Flight: Recurve Bow Tuning"; The Bow International 70 Metre Internet Archery League; www.meta-synthesis.com/archery/archery.html; Nov. 18,2013; pp. 1-24.
"Atmospheric Flight; NASA Quest"; www.quest.nasa.gov/aero/planetary/atmospheric/aerodynamiclift.html Nov. 12, 2013; pp. 1-10.

* cited by examiner

*Primary Examiner* — John Ricci

(57) ABSTRACT

A broadhead arrowhead has a cylindrical central body having a longitudinal axis and a plurality of wing blades that extend radially from the central body. Each wing blade includes a generally triangular surface including a leading edge, a trailing edge and a root edge along the central body. A foil portion is formed in each wing blade and defined by a line extending from a forward point where the wing blade meets the central body at the root edge to the trailing edge. The leading edge is sharpened and each wing blade is oriented in the same circumferential direction with respect to the central body.

25 Claims, 7 Drawing Sheets

FIG. 7
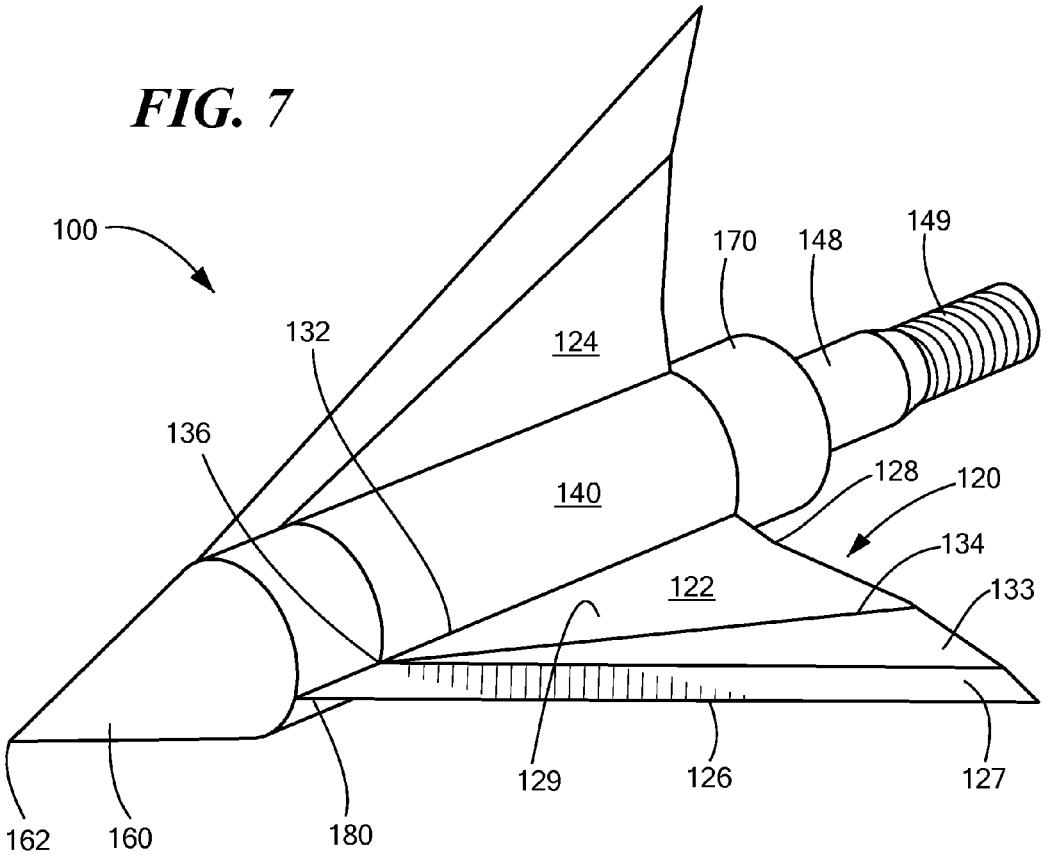
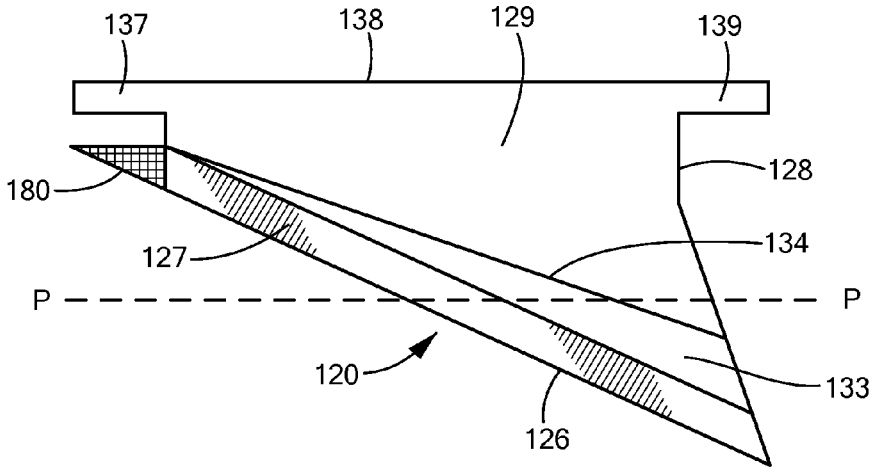
FIG. 8

BROADHEAD ARROWHEAD

BACKGROUND OF THE INVENTION

As is generally known, an arrow includes an arrowhead at one end of the shaft with the other end having, historically, feathers and an end configured to couple to the string of a bow, such as for archery or hunting. A broadhead arrowhead, or broadhead, is an arrowhead having a number of sharp blades extending radially outwardly and is primarily used for hunting. Broadhead arrowheads are generally less streamlined and less aerodynamic than other types of arrowheads.

To impart a rotation to the arrowhead, which aids in better flight characteristics, some broadheads are formed with blades attached on a spiral path along a core member of the arrowhead and/or are formed with blades having curved upper and lower surfaces. One known arrowhead includes blades that, in effect, have an air brake along the trailing edge. Such an arrowhead creates rotation by air friction or air resistance against the blades as the arrow moves along its flight path.

What is needed, however, is a broadhead arrowhead with improved aerodynamics.

SUMMARY OF THE INVENTION

A broadhead arrowhead is provided that, when attached to an arrow shaft and launched, imparts a spin or rotation to the arrowhead. The arrowhead includes a plurality of wing blades disposed equidistantly about a central body. Each wing blade includes a bend generally adjacent a sharpened leading edge that imparts an airfoil shape to the wing blade. Airflow over the wing blades generates lift on the wing blades, tending to rotate the entire arrowhead during flight.

In one embodiment, an arrowhead includes an elongated cylindrical central body having a longitudinal axis, an outer surface, a front end and a rear end; and a plurality of wing blades positioned about the outer surface of the central body. Each wing blade includes an upper surface and a lower surface and a leading edge, a trailing edge and a root edge defined where the wing blade meets the central body. A beveled portion is provided in the upper surface to sharpen the leading edge; and a foil portion is provided in the wing blade between the beveled portion and a line running parallel to the leading edge and extending from a forward most point on the root edge to a point on the trailing edge.

In one embodiment, the beveled edge is provided only in the upper surface.

BRIEF DESCRIPTION OF THE DRAWINGS

Various aspects of at least one embodiment of the present invention are discussed below with reference to the accompanying figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, not every component may be labeled in every drawing. The figures are provided for the purposes of illustration and explanation and are not intended as a definition of the limits of the invention. In the figures:

FIG. 7 is an isometric view of a broadhead arrowhead in accordance with another embodiment of the present invention;

FIG. 8 is a top view of a wing blade of the embodiment shown in FIG. 7;

DETAILED DESCRIPTION OF THE INVENTION

Figure 1:
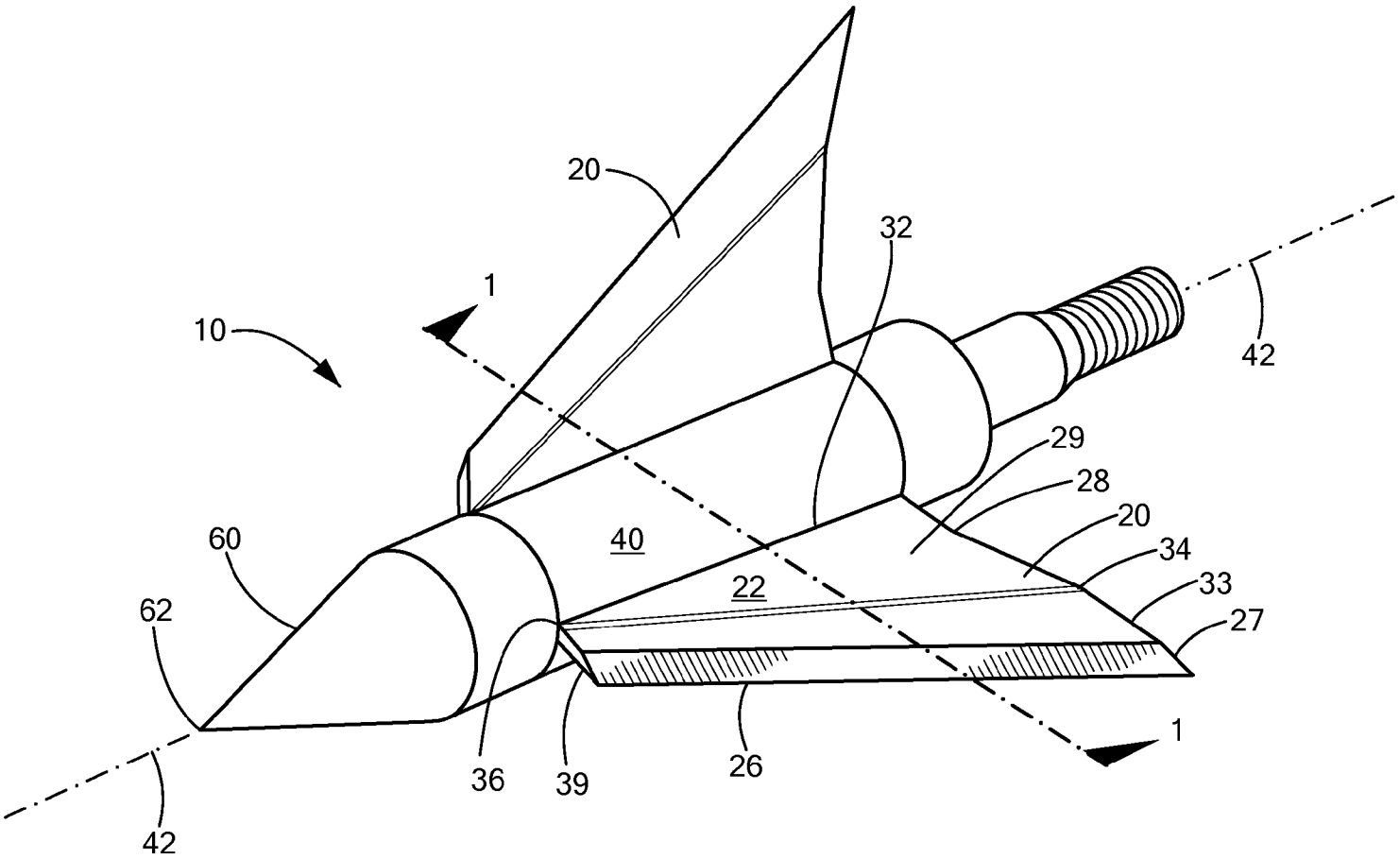
FIG. 1 is an isometric view of a broadhead arrowhead according to an embodiment of the present invention.

In the following description, numerous specific details are set forth in order to provide a thorough understanding of the embodiments of the present invention. It will be understood by those of ordinary skill in the art that these embodiments of the present invention may be practiced without some of these specific details. In other instances, well-known methods, procedures, components and structures may not have been described in detail so as not to obscure the embodiments of the present invention.

Prior to explaining at least one embodiment of the present invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein are for the purpose of description and should not be regarded as limiting.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Figure 2:
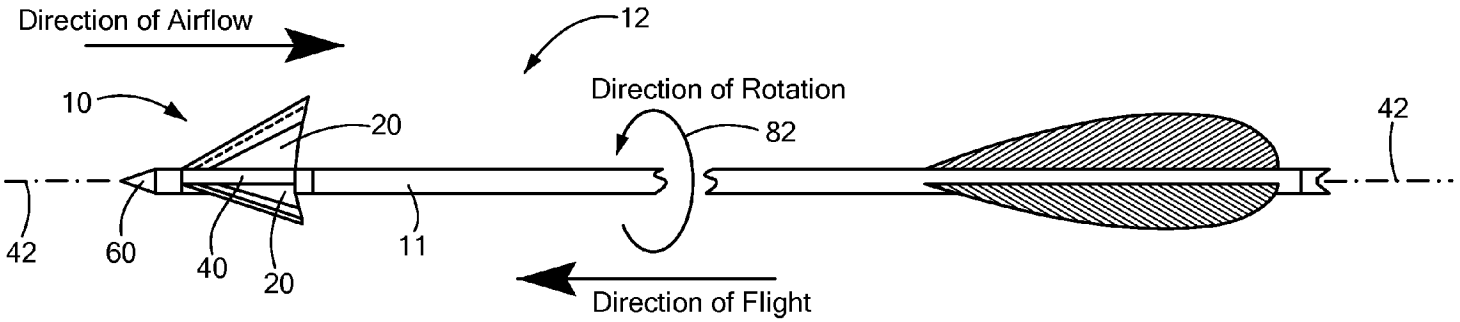
FIG. 2 is a side view of an arrow with the broadhead arrowhead of FIG. 1 on the tip.

A broadhead arrowhead 10, herein referred to as either the broadhead 10 or arrowhead 10, as shown in FIG. 1, includes several wing blades 20 disposed circumferentially about a central body 40. The arrowhead 10 also includes a tip 60 with a sharp point 62. The arrowhead 10 is attached to a shaft 11 of an arrow 12, as shown in FIG. 2. Each wing blade 20 has a shape that generates lift on one surface, designated herein as an upper surface 22. The wing blades 20 are positioned in the same orientation with respect to the central body 40, as shown in FIG. 1 and in FIG. 3, the latter figure being a view looking into the sharp point 62. The blades 20 are also equally spaced circumferentially about the central body 40.

Figure 6A:
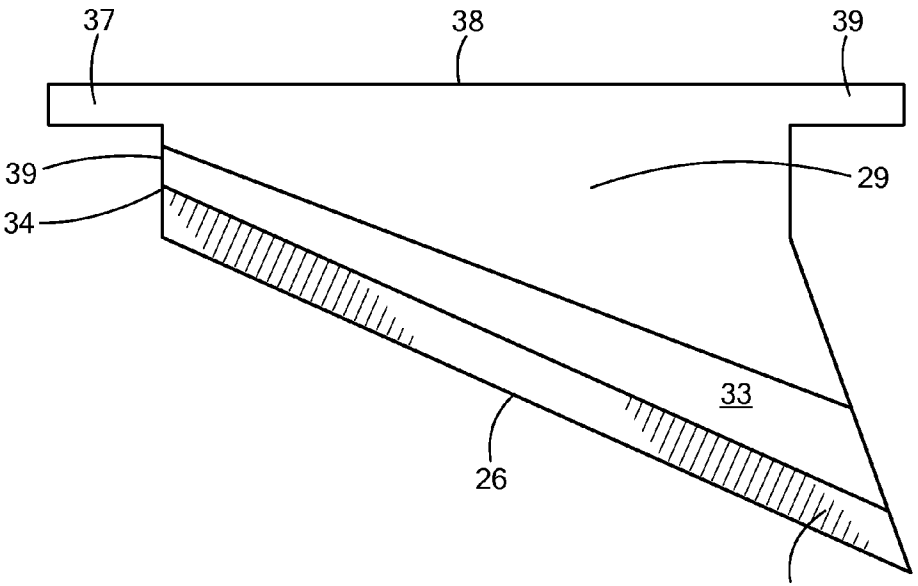
FIGS. 6A-6C are top, side and front perspective views, respectively, of a wing blade in accordance with one embodiment of the present invention.
Figure 6B:
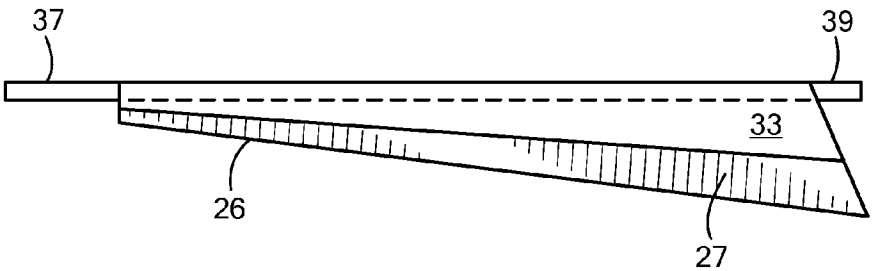
Figure 6C:
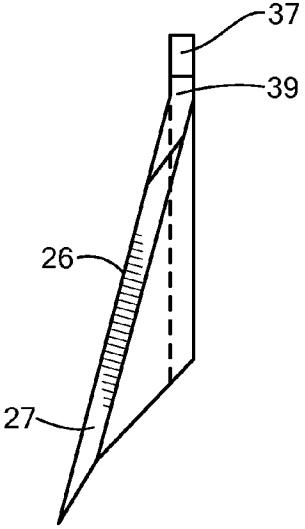

Each wing blade 20 has substrate with a generally triangular planform or shape in plan view having a leading edge 26, a trailing edge 28, and a root edge 32 defined where the blade makes contact with the central body 40, as shown in FIG. 1. The wing blade 20 is generally triangular as this embodiment of the present invention includes a shoulder portion 39, as shown in FIGS. 6A-6C. Each wing blade 20 includes an upper surface 22 and a lower surface 24. The leading edge 26 is defined by sharpening, i.e., providing an angled or beveled surface 27 on the upper surface 22. In one embodiment, only the upper surface 22 has the beveled surface 27.

Figure 11:
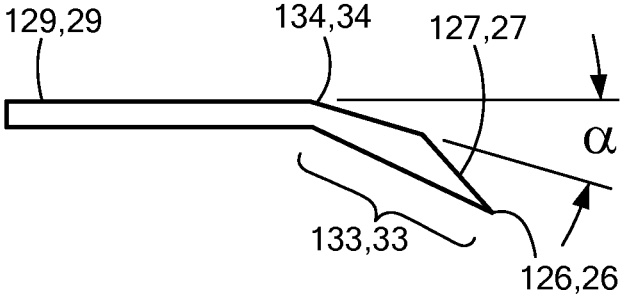
FIG. 11 is a cross section along the line 1-1 of a wing blade of the broadhead arrowhead as shown in FIG. 1.

A foil section 33 is provided in the upper surface 22 and is defined between a bend line 34 and the leading edge 26, including the beveled surface 27. Thus, the foil section 33 is at an angle $\alpha$ with respect to a flat first section 29 of the wing blade 20, as shown in FIG. 11. The bend line 34 extends from a forward-most point 36 where the wing blade 20 meets the central body 40 at the root edge 32 to a point on the trailing edge 28.

The angle $\alpha$ of the foil section 34 from the plane of the wing 10 should be at least 5° and can range from 5° to 40°. The bend line 34 can be parallel to the leading edge 26 or at a slight angle with respect to the leading edge 26. Generally, that angle should be in a range of 0° to 45°.

The wing blades 20 are positioned with respect to the central body 40 with the root edge 32 longitudinally aligned to be parallel or coplanar to a longitudinal axis 42 of the central body 40. In one embodiment, the wing blades 20 are positioned to be coplanar with the longitudinal axis 42 of the central body 40.

Figure 3:
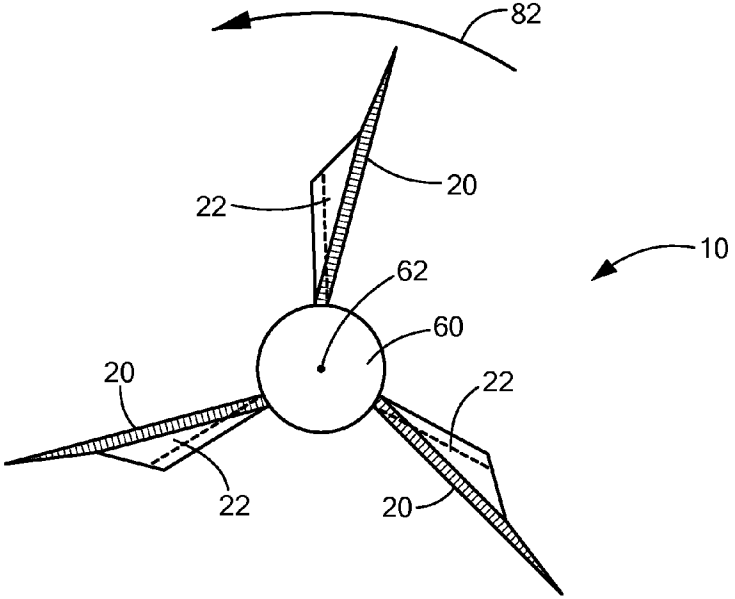
FIG. 3 is a front elevation view of the broadhead arrowhead of FIG. 1.
Figure 10:
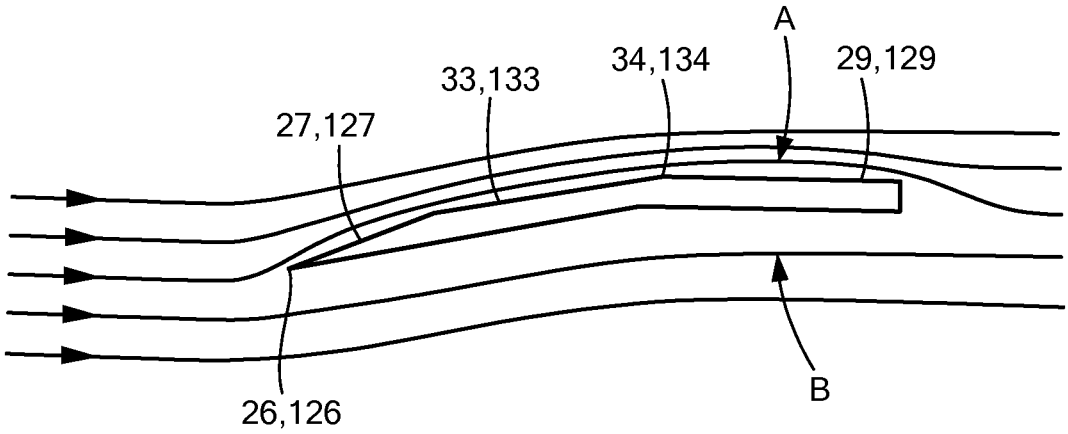
FIG. 10 is an airflow diagram of the wing blades of the present invention.

The configuration of the wing blade 20 creates an airfoil which is enhanced by the sharpened or beveled surface 27, i.e., the foil section 34 and the sharpened leading edge 26 impart a slight airfoil shape to the wing blade such that, during flight, the air flow path length across the upper surface is greater than the air flow path length across the lower surface, generating lift, as shown in FIG. 10 where reference A is referring to stream lines crowded together indicating low local static pressure as compared to reference B where the static pressure is higher. When the arrow 12 is in flight, as the lift is generated over the upper surface 22 of each wing blade 20, which tends to impart a roll or a rotation 82 about a longitudinal axis 42 of the arrowhead and the arrow 12, as shown in FIGS. 2 and 3. This is not power bleeding and the rotation is not thought to be due to air friction but, rather, inertia drives the rotation. The lower pressure created in front of the arrow in flight is like punching a hole in the air ahead, similar to the bow of a ship punching a hole in the water ahead. Advantageously, this non-power bleeding effect allows the arrow to fly further and straighter similar to a bullet fired from a rifled barrel.

In the orientation illustrated in the figures, the rotation in flight is in the counterclockwise direction, as represented by rotation 82 when the arrowhead 10 is viewed from the front, as shown in FIG. 3. Of course, if the foil section 34 was angled in the opposite direction with respect to the plane of the wing, the arrow would spin in the clockwise direction.

Figure 4:
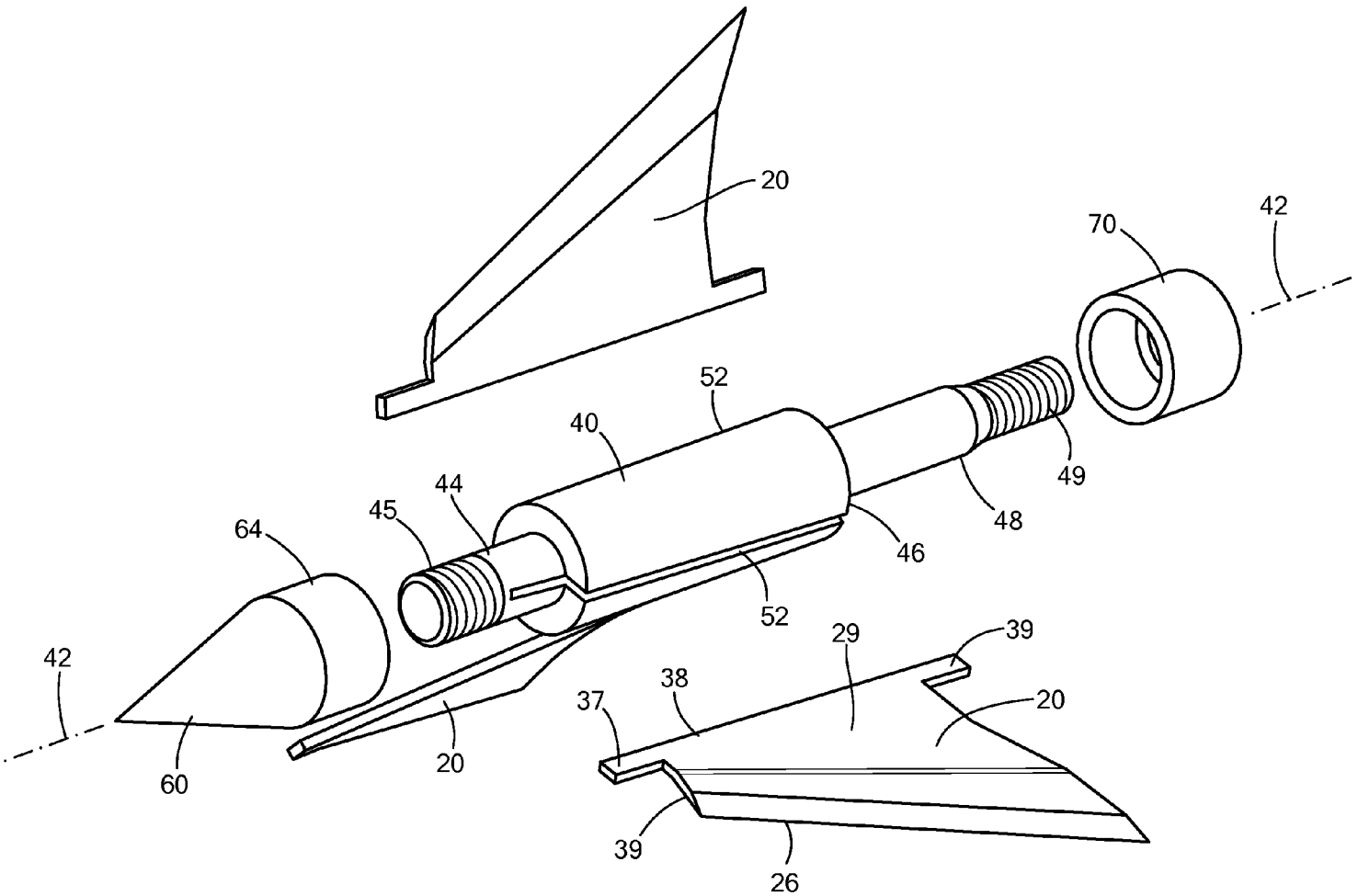
FIG. 4 is an exploded isometric view of the broadhead arrowhead of FIG. 1.

The arrowhead 10, in one embodiment, is assembled from separate components, as shown in FIG. 4. Advantageously, this structure allows for a damaged component, particularly a wing blade 20, to be replaced or repaired. Referring to FIG. 4, the body 40 has a head portion 44, a central portion 46 and a tail portion 48 aligned along the longitudinal axis 42. The central portion 46 has the form of an elongated cylinder having a diameter in cross section that is larger than the cross-sectional diameters of the head portion 44 and the tail portion 48. The tip 60 is attached to the central body 40 by, for example, threads 45 on the front end of the head portion 44. The tail portion 48 is configured for attachment to the shaft 11 of the arrow 12 in any suitable manner, such as by threads 49 formed on the tail portion 48. A thread locking adhesive may be used on the threads 45, 49 to prevent loosening.

The body 40 includes a plurality of longitudinal slots 52 formed along the length of the body in parallel alignment with the longitudinal axis 42 of the body. Each slot 52 extends the full length of the central portion 46. Each slot 52 also extends a forward distance into the head portion 44 and a rearward distance into the tail portion 48. Each longitudinal slot 52 corresponds to one of the wing blades 20, so there is one slot for each wing blade 20. Typically, three slots 52 and three wing blades 20 are provided, although another number, such as two, four, five, or six, could be used if desired. If, however, too many wing blades 20, generally, more than six, are provided, the weight of the arrowhead 10 may increase to a point of negativity affecting proper flight.

Each wing blade 20 includes a longitudinally extending root portion 38 that fits into a respective slot 52 on the body 40. The root portion 38 includes a forward extension 37 and a rear extension 39. The length of the root portion 38 corresponds to the length of the slot 52 on the body 40. The root portion 38 fits into a corresponding slot 52 with the forward extension 37 of the root portion 38 received within the slot 52 in the head portion 44 of the body 40 and the rear extension 39 of the root portion 38 received within the slot 52 in the tail portion 48 of the body. The depth of the slot 52 is the same, or substantially the same within manufacturing tolerances, as the depth of the forward 37 and rear 39 extensions of the wing root portion 38 so that the extensions 37 and 39 do not protrude above the exterior surface of the central portion 46 of body 40, and the wing blades 20, when attached, and fit snugly, not loosely, to the body 40.

The wing blades 20 are locked onto the body 40 by the tip 60 attached to the head portion 44 and by a collet 70 that is sized to fit over the tail portion 48 of the body 40, i.e., to enclose or capture, the extensions 37, 39 within the slots 52. The tip 60 is, in one embodiment, a hollow, cone-shaped portion and includes the sharp point 62 as shown or otherwise shaped or faceted to achieve the sharp point 62. In one embodiment 60, the tip includes a generally cylindrical and threaded back end 64 sized to attach to the threaded front end 45 of the head portion 44 of the body 40. The inner diameter of the second portion fits over the rest of the head portion 44 of the body so that the aft face of the tip abuts a forward face of the central portion of the body 40.

The collet 70 is cylindrical and has an exterior diameter that is the same, or substantially the same within manufacturing tolerances, as the exterior diameter of the central portion 46 of the body 40. The collet 70 includes a hollow interior having an inner diameter that fits over the rear extensions 39 when fitted within the slots 52 in the tail portion 48.

Figure 5:
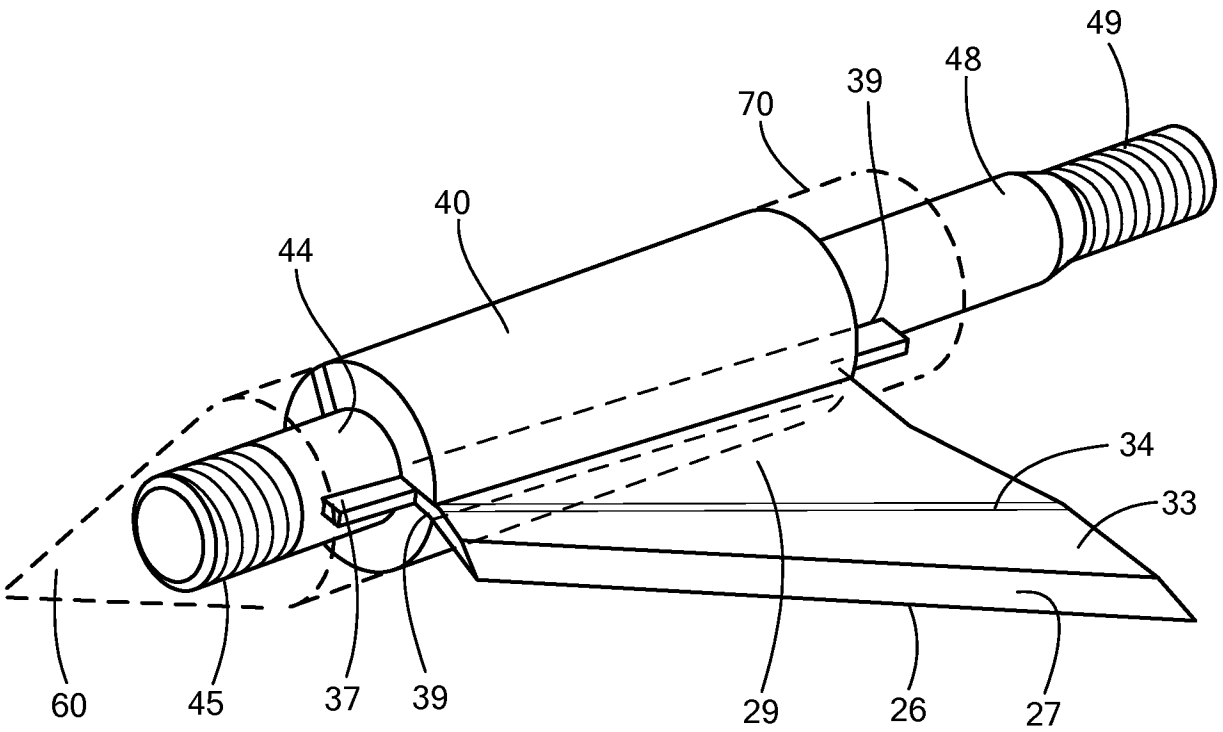
FIG. 5 is a partial isometric side view of the broadhead arrowhead of FIG. 1.

Thus, as shown in FIG. 5, when the tip 60 is screwed on it will capture the forward extensions 37 of the wings 20. When the collet 70 is slid into position, it will capture the rear extensions 39. Screwing the arrowhead 10 onto the arrow shaft will hold the collet 70 in place.

In another embodiment of the present invention, a broadhead arrowhead 100, as shown in FIG. 7, includes several wing blades 120 disposed circumferentially about a central body 140 similar to the one shown in FIG. 1. The arrowhead 100 also includes a tip 160 with a sharp point 162 on the front. Each wing blade 120 has a shape that generates lift on one surface, designated herein as an upper surface 122. The wing blades 120 are positioned in the same orientation with respect to the central body 140. The blades 120 are also equally spaced circumferentially about the central body 140.

Figure 9:
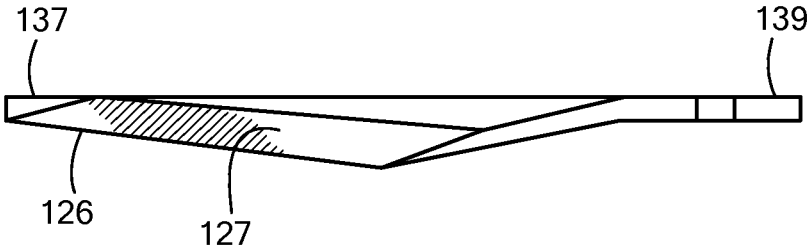
FIG. 9 is a cross-sectional view of the wing blade of FIG. 8 as viewed along the line P-P in FIG. 8.

Each wing blade 120 has a substrate with generally triangular planform or shape in plan view having a leading edge 126, a trailing edge 128 and a root edge 132 defined where the blade makes contact with the central body 140, as shown in FIG. 7. The wing blade 120 is generally triangular as this embodiment of the present invention includes a beveled triangular portion 180, as shown in FIG. 8, that is not found on the wing blade 20. Although the triangular portion 180 is shown in cross-hatch, this is merely to point out the structural different and is not intended to indicate that the portion 180 is a separate section. The beveled surface 127 is continuous. A cross-section of the wing blade 120 along the line P-P in FIG. 8 is presented in FIG. 9. Each wing blade 120 includes an upper surface 122 and a lower surface 124. The leading edge 126 is defined by sharpening, i.e., providing an angled or beveled surface 127 on the upper surface 122. In one embodiment, only the upper surface 122 has the beveled surface 127.

A foil section 133 is provided in the upper surface 122 and is defined between a bend line 134 and the leasing edge 126 including the beveled surface 127. Thus, the foil section 133 is at the angle $\alpha$ with respect to a flat first section 129 of the wing blade 120, also as shown in FIG. 11. The bend line 134 extends from a forward-most point 136 where the wing blade 120 meets the central body 140 at a point on the root edge 132 to the trailing edge 128. This foil section 134 and the sharpened leading edge 126 impart a slight airfoil shape to the wing blade such that, during flight, the air flow path length across the upper surface is greater than the air flow path length across the lower surface, generating lift, as shown in FIG. 10.

Each wing blade 120 includes a longitudinally extending root portion 138 that fits into a respective slot on the body 140. The root portion 138 includes a forward extension 137 and a rear extension 139, so that the root portion 138 is longer in the longitudinal direction than the adjacent wing surface. The length of the root portion 138 corresponds to the length of the slot on the body 140.

In one embodiment, the wing blades 120 are locked onto the body 140 by the tip 160 attached to the head portion 144 and by a collet 170 that is sized to fit over the tail portion 148 of the body 140, i.e., to enclose or capture, the extensions 137, 139 within the slots. The tip 160 is, in one embodiment, a hollow, cone-shaped portion and includes the sharp point 162 as shown or otherwise shaped or faceted to achieve the sharp point 162. In one embodiment, the tip includes a generally cylindrical and threaded back end 164 sized to attach to the threaded front end 145 of the head portion 144 of the body 140. The inner diameter of the second portion fits over the rest of the head portion 144 of the body so that the aft face of the tip abuts a forward face of the central portion of the body 140.

The collet 170 is cylindrical and has an exterior diameter that is the same, or substantially the same within manufacturing tolerances, as the exterior diameter of the central portion 146 of the body 140. The collet 170 includes a hollow interior having an inner diameter that fits over the rear extensions 139 of the wing root portions 139 when fitted within the slots in the tail portion 148.

Thus, when the tip 160 is screwed on it will capture the forward extensions 137 of the wings 120. When the collet 170 is slid into position, it will capture the rear extensions 139. Screwing the arrowhead 100 onto the arrow shaft will hold the collet 170 in place.

Of course, one of ordinary skill in the art will understand that there are many different ways in which the tip and collet could be permanently positioned. For example, these pieces could be permanently added by placing glue within the threads and then screwed on. In addition, assuming that doing so does not affect the performance, the components could be welded in place without using threads or the seams could be welded after being positioned.

The arrowhead 10 can be manufactured by any suitable manner. For example, the various components can be machined from suitable metal materials by, for example, operation of a CNC machine. The bend in the wing blades can be formed by a press brake or other suitable machine tool. The blades are suitably made of steel to hold an edge. Surgical grade steels, mild steels, and grades 302, 316 and 18/8 steels are suitable. The body 40 should be strong enough to carry the blades 20 but not too heavy. In one suitable embodiment, the body 40 is made of 6061 anodized aluminum. Alloys of aluminum, titanium, and magnesium can be used. Steel is heavier and is thus less suitable for the body 40. The arrowhead 10 can also be formed in a single piece, such as by molding or three-dimensional printing processes. Still further, the arrowhead could be a hybrid assembly in that some pieces are plastic and others are metal, ceramic, carbon fiber, etc.

Having thus described several features of at least one embodiment of the present invention, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

The invention is not to be limited by what has been particularly shown and described, except as indicated by the appended claims.

What is claimed is:

1. An arrowhead, comprising:

an elongated cylindrical central body having a longitudinal axis, an outer surface, a front end and a rear end; and a plurality of wing blades positioned about the outer surface of the central body, wherein each wing blade comprises:

a substrate having an upper surface, a lower surface, a leading edge, a trailing edge and a root edge defined where the wing blade meets the central body;

a first portion defined in the wing blade between the root edge and a bend line extending from a forward most point on the root edge to a point on the trailing edge;

a foil portion, provided in the wing blade between the bend line and the leading edge; and a beveled portion provided in the upper surface of the foil portion to sharpen the leading edge, wherein the foil portion is at a predetermined angle with respect to the first portion.

2. The arrowhead of claim 1, wherein the wing blades are spaced equidistantly about a circumference of the central body.

3. The arrowhead of claim 1, wherein each wing blade is provided in a same orientation with respect to the central body.

4. The arrowhead of claim 1, wherein the central body further comprises:

a plurality of slots provide in the outer surface of the central body, wherein a respective wing blade is provided in a respective slot.

5. The arrowhead of claim 4, wherein each slot is generally parallel to the longitudinal axis of the central body.

6. The arrowhead of claim 4, wherein each slot is at a predetermined angle with respect to the longitudinal axis of the central body.

7. The arrowhead of claim 1, wherein each wing blade comprises a generally triangular shape.

8. An arrowhead, comprising:

an elongated cylindrical central body having a longitudinal axis, a front end, a rear end configured for attachment to a shaft of an arrow;

a plurality of wing blades attached to the central body, each wing blade extending radially from the central body, the wing blades spaced equidistantly about a circumference of the central body;

each wing blade comprising:

a substrate having a generally triangular shape and comprising an upper surface, a lower surface, a leading edge, a trailing edge and a root edge defined where the wing blade meets the central body;

a first portion defined in the wing blade between the root edge and a bend line extending from a forward most point on the root edge to a point on the trailing edge;

a foil portion, provided in the wing blade between the bend line and the leading edge; and a beveled portion provided in the upper surface of the foil portion to sharpen the leading edge, wherein the foil portion is at a predetermined angle with respect to the first portion, and wherein each wing blade is positioned in a same orientation with respect to the central body.

9. The arrowhead of claim 8, wherein:

each wing blade includes a longitudinally extending root portion;

the central body includes longitudinally extending slots, and the root portion of each wing blade is disposed in a respective slot on the central body.

10. The arrowhead of claim 9, wherein:

the central body includes a head portion and a tail portion, the slots in the central body extending partially into the head portion and the tail portion; and the root portion includes a forward extension and a rear extension, and the root portion fits into the respective corresponding slot with the forward extension received within the slot in the head portion of the body and the rear extension received within the slot in the tail portion of the body.

11. The arrowhead of claim 10, wherein the tip attaches to the central body over the head portion, retaining the forward extension of the wing root portion within the slot at the head portion.

12. The arrowhead of claim 10, further comprising a collet that attaches to the central body over the tail portion, retaining the rear extension of the wing root portion within the slot at the tail portion.

13. The arrowhead of claim 8, wherein the foil portion extends generally parallel to the leading edge.

14. The arrowhead of claim 8, wherein the foil portion extends generally along and adjacent to the leading edge.

15. The arrowhead of claim 8, wherein the root edge is longitudinally aligned parallel with the longitudinal axis of the central body.

16. The arrowhead of claim 8, comprised of a metal or metal alloy.

17. The arrowhead of claim 8, wherein the blades are comprised of steel.

18. The arrowhead of claim 8, wherein:

each wing blade is oriented in a same circumferential direction with respect to the central body.

19. The arrowhead of claim 8, wherein each wing blade is configured with an airfoil shape defined between the upper surface and the lower surface.

20. An arrow, comprising:

an arrow shaft having a first end; and the arrowhead of claim 8 attached to the first end of the arrow shaft.

21. A wing blade for use in a broadhead arrowhead, the wing blade comprising:

a substrate having an upper surface, a leading edge, a trailing edge and a root edge;

a first portion defined in the substrate between the root edge and a bend line extending from a forward most point on the root edge to a point on the trailing edge;

a foil portion, provided in the wing blade between the bend line and the leading edge; and a beveled portion provided in the upper surface of the foil portion to sharpen the leading edge, wherein the foil portion is at a predetermined angle with respect to the first portion.

22. The wing blade of claim 21, wherein the substrate comprises surgical grade steel.

23. The wing blade of claim 21, wherein the bend line is substantially parallel to the leading edge.

24. The wing blade of claim 21, wherein the bend line is at a predetermined angle with respect to the leading edge.

25. The wing blade of claim 21, wherein the substrate has a generally triangular shape.

* * * * *